United States Patent [19]

Groenhof

[11] 4,449,415

[45] May 22, 1984

[54] TRACTION FLUID AND TRACTION DRIVE SYSTEM CONTAINING SAID FLUID

[75] Inventor: Eugene D. Groenhof, Freeland, Mich.

[73] Assignee: Dow Corning Corporation, Midland, Mich.

[21] Appl. No.: 304,726

[22] Filed: Sep. 23, 1981

[51] Int. Cl.[3] ..... F16H 55/32; C10M 1/16; C10M 1/54

[52] U.S. Cl. ..... 74/214; 252/49.6

[58] Field of Search ..... 252/49.6; 74/190, 214, 74/200; 556/455

[56] References Cited

U.S. PATENT DOCUMENTS

| | | | |
|---|---|---|---|
| 3,440,894 | 4/1969 | Hammann et al. | 74/200 |
| 3,652,418 | 3/1972 | Wygant | 252/73 |
| 3,994,816 | 11/1976 | Wygant | 252/73 |
| 4,190,546 | 2/1980 | Kulik et al. | 252/49.6 |

OTHER PUBLICATIONS

Rounds, *J. Chem. Engr. Data,* vol. 5, pp. 499–507, 1960.

"Base Fluids" in *Functional Fluids for Industry, Transportation and Aerospace,* M. W. Ranney (Ed), Noyes Data Corp., Park Ridge, N.J. (1980).

R. L. Green, et al., *Mach Design,* 46, 108–113 (1974).

*Primary Examiner*—W. J. Shine

*Attorney, Agent, or Firm*—R. A. Kaba

[57] ABSTRACT

Traction fluids containing certain siloxane components and, optionally, certain cycloaliphatic hydrocarbon components are described. These traction fluids possess high traction coefficients and good low temperature viscosity properties which make these fluids ideally suited for use in traction drive systems subjected to wide operating temperature conditions.

27 Claims, No Drawings

TRACTION FLUID AND TRACTION DRIVE SYSTEM CONTAINING SAID FLUID

FIELD OF THE INVENTION

This invention relates to traction fluids containing certain siloxane components and, optionally, certain cycloaliphatic hydrocarbon components. The traction fluids of this invention are particularly well suited for use in traction drive systems and transmissions subject to wide operating temperature conditions.

DESCRIPTION OF THE PRIOR ART

A traction drive is a device by which torque can be transmitted from one smooth rolling element to another wherein the rolling elements are in nominal point or line contact. One such simple traction drive might consist of two parallel cylindrical elements in nominal line contact where one element is the input member and the other is the output member. As is well known in the art, both fixed speed and variable speed traction drives can be made by proper selection of the number, size, shape, and geometrical configuration of the roller elements. The continuously variable speed traction drive is attracting current interest for automotive applications because it has been estimated that use of such a traction drive could result in increased fuel efficiencies of 30–50% without sacrificing vehicle performance. Another advantage of traction drives over conventional transmissions is the smooth and quiet operation of the traction drive.

The limited lifetime and load carrying capabilities of traction drives have substantially prevented their widespread use except for light-duty applications. Recently, however, the development of better lubricants, called traction fluids, have allowed the development of traction drive transmissions which are suitable for heavy-duty applications. Indeed, the properties of the traction fluid, which also acts as a lubricant and coolant in the traction drive, determines to a large degree the performance, capacity, and lifetime of the traction drive. Of critical importance are the properties of the traction fluid under the high pressure and high shear conditions found in the area of contact between the roller elements. Although the roller elements are usually spoken of as being in contact, it is generally accepted that the roller elements are separated by a thin film of the tractive fluid. It is through the traction fluid's resistance to shear that the torque transmitting ability of a given fluid arises. The torque transmitting ability of a fluid, and thus its suitability as a traction fluid, is measured by and is directly related to its traction coefficient. The numerical value of traction coefficients is very dependent upon the experimental conditions employed. Therefore, the reader is cautioned against directly comparing traction coefficient data obtained under differing experimental conditions.

Hammann, et al. disclosed in U.S. Pat No. 3,440,894 (Apr. 29, 1969) that certain classes of fluids characterized by high traction coefficient and molecular structure were superior traction fluids. Wygant in U.S. Pat. No. 3,994,816 (Nov. 30, 1976) discloses that certain hydrogenated dimers of alpha-methylstyrene (e.g. 2,4-dicyclohexyl-2-methyl pentane) are suitable as traction fluids. Both U.S. Pat. Nos. 3,440,894 and 3,994,816 are assigned to Monsanto Co. and both cited patents are incorporated by reference herein. U.S. Pat. No. 3,994,816 is further discussed in an article entitled "Base Fluids" in *Functional Fluids for Industry, Transportation and Aerospace,* M. W. Ranney (Ed), Noyes Data Corporation, Park Ridge, N.J. (1980). Among the disclosed traction fluids were the cycloaliphatic hydrocarbon species. Preferred cycloaliphatic hydrocarbons are now offered as traction fluids by Monsanto Company under the tradename Santotrac. Although the Santotrac fluids offer high traction coefficients they have one major disadvantage which has prevented the more widespread utilization of traction drives. At sub-zero temperatures the viscosity of the Santotrac fluid increases dramatically. For example, one Santotrac fluid has a viscosity of 31,600 centistokes at −20° F. and an estimated viscosity of 200,000 centistokes at −40° F. Clearly such fluids could not be successfully used in applications subjected to low temperature extremes. One such application, for example, in which a Santotrac fluid traction drive might not be successfully employed would be vehicles exposed to sub-zero temperatures.

Several attempts have been made to develop fluids with reasonable low temperature viscosity and high traction coefficients. Wygant in U.S. Pat. No. 3,652,418 (Mar. 28, 1972) discloses that a low temperature traction fluid can be prepared by blending 30–60% by weight hydrogenated dicumyl, 30–60% by weight tercyclohexyl, and at least 5% by weight dicyclohexyl or certain alkyl dicyclohexyl. The traction coefficient of the blend could be estimated from the relationship $$f_t = f_{t1}C_1 + f_{t2}C_2 + \ldots + f_{tn}C_n$$

when $f_t$ is the traction coefficient of the mixture; $f_{t1}$, $f_{t2}$, and $f_{tn}$ are the traction coefficients of the components; and $C_1$, $C_2$, $C_n$ are the weight percentage of the components. The disclosed blends of Wygant (U.S. Pat. No. 3,652,418) gave acceptable traction coefficients and improved low temperature viscosities as compared to U.S. Pat. No. 3,440,894 traction fluids. However, Wygant (U.S. Pat. No. 3,652,418) admits that his blended traction fluids gave only "operable viscosity ranges over temperatures of 0° to 210° F."

Kulik and Smith in U.S. Pat. No. 4,190,546 (Feb. 26, 1980) disclosed that a traction fluid with acceptable low temperature properties and traction coefficients could be obtained by blending a Santotrac fluid with a silicone fluid containing from 15 to 25 methyl groups per phenyl group if, and only if, about 2 to 10% by weight of an aromatic hydrocarbon or aromatic ether co-solvent is added. The co-solvent is required to ensure complete miscibility of the siloxane and Santotrac fluids. Blends prepared in accordance with this patent (see blend numbers 8 through 13 therein) were reported to have a viscosity of less than 10,000 centistokes at −40° F. However, if the co-solvent is omitted from the blend, the mixtures of the Santotrac and siloxane fluids of U.S. Pat. No. 4,190,546 are not miscible and therefore have extremely poor low temperature viscosity properties. Although the traction fluids of U.S. Pat. No. 4,190,546 have excellent low temperature viscosity properties and good traction coefficients, they are not without their disadvantages. The use of a co-solvent in the formulation is an additional expense to the oil blender, both in terms of material and quality assurance. Also, the co-solvents employed have appreciably lower boiling points than do the Santotrac or siloxane components. Therefore, it is possible that a portion of the co-solvent may be lost at the high operating temperatures of a traction drive. Loss of the co-solvent would yield a traction fluid with poor low temperature viscosity properties. Therefore, one might expect a reduced lifetime for the traction fluids of U.S. Pat. No. 4,190,546 due to possible loss of the co-solvent. Indeed, in our hands a mixture of a Santotrac fluid, a siloxane, and diphenyl ether (made up as blend 9 in U.S. Pat. No. 4,190,546), when heated to 150° C. for 4 hours in an open container, lost sufficient amounts of the co-solvent to render the remaining components immiscible when cooled to −30° F. and nonflowable when cooled to −40° F. Additionally, the use of a co-solvent may not guarantee miscibility of the cycloaliphatic hydrocarbon and siloxane when conventional oil additives are also employed in the formulation. All examples in U.S. Pat. No. 4,190,546 employed Santotrac 40, a Santotrac fluid containing no reported additives. Santotrac 50, on the other hand, contains conventional additives to reduce wear, rust, and foam in a traction drive. (See R. L. Green and F. L. Langenfeld, "Lubricants For Traction Drives," *Mach. Design,* 46, 108–113 (1974), which is incorporated herein by reference, for a more detailed discussion of the various grades of Santotrac fluids.) In our hands blends made in accordance with U.S. Pat. No. 4,190,546 using Santotrac 40 did indeed remain miscible and flowable when cooled to −40° F. However, similar blends prepared with Santotrac 50 were found to be nonmiscible and nonflowable when cooled to −40° F.

Siloxanes have been evaluated for use as traction fluids. However, in general, the traction coefficients of the prior art siloxane fluids were too low to be useful in traction drive devices. F. G. Rounds ("Effect of Lubricant Composition on Friction as Measured With Thrust Ball Bearings," *J. Chem. Engn. Data,* 5, 499–507 (1960)) found that several different siloxanes had traction coefficients approximately equal to that found for mineral oils. The mineral oils have traction coefficients much lower than that of cycloaliphatic hydrocarbons such as Santotrac. One siloxane, a chlorophenyl silicone, was reported in the technical paper by Green and Langenfeld cited above, to have a traction coefficient approaching that found for the cycloaliphatic hydrocarbons. However, this chlorophenyl silicone was not suitable as a traction fluid because of its poor resistance to oxidation and moisture and the resulting tendency to gel.

This invention is directed primarily to providing a traction fluid that avoids the problems associated with prior art fluids, especially at low temperatures.

Accordingly, it is an object of the present invention to provide compositions suitable for use as traction fluids.

Also it is an object of this invention to provide compositions particularly well suited for use as traction fluids in low temperature applications.

Furthermore, it is an object of this invention to provide improved traction drive systems particularly well suited for operating under widely varying temperature environments.

SUMMARY OF THE INVENTION

The compositions of the invention, useful as traction fluids, consist essentially of (A) 30–100% by weight of a trimethylsiloxy end-blocked siloxane fluid of (MeRSiO) units and, optionally, ($Me_2SiO$) units where Me is a methyl radical and R is selected from the group consisting of phenyl radicals and cyclohexyl radicals, where there are about 1.6 to 14 methyl radicals for each R radical, said siloxane fluid having a kinematic viscosity of about 20 to 200 centistokes at 77° F.; and (B) 0–70% by weight of a cycloaliphatic hydrocarbon or a mixture of cycloaliphatic hydrocarbons, where said cycloaliphatic hydrocarbon contains from about 12 to 70 carbon atoms and at least one saturated ring containing at least six carbon atoms;

where components (A) and (B) of said traction fluid remain compatible and miscible when cooled to −40° F. and said traction fluid has a kinematic viscosity of less than 15,000 centistokes at −20° F.

The traction fluids of this invention possess good traction coefficients and operable viscosity ranges at temperatures as low as −40° F. Therefore, the compositions of this invention are well suited for use in traction drives subjected to low temperatures.

The traction fluids of this invention can be employed alone or with additives such as anti-wear agents, anti-oxidation agents, anti-rust agents, anti-foam agents, etc. Such additives are well known in the art.

An improved traction drive system having at least two relatively rotatable members in a torque transmitting relationship and a fluid disposed on the tractive surfaces of said members is also described where the improvement comprises employing, as said fluid, a fluid consisting essentially of (A) 30–100% by weight of a trimethylsiloxy end-blocked siloxane fluid of (MeRSiO) units and, optionally, ($Me_2SiO$) units where Me is a methyl radical and R is selected from the group consisting of phenyl radicals and cyclohexyl radicals, where there are about 1.6 to 14 methyl radicals for each R radical, said siloxane fluid having a kinematic viscosity of about 20 to 200 centistokes at 77° F.; and (B) 0–70% by weight of a cycloaliphatic hydrocarbon or a mixture of cycloaliphatic hydrocarbons, where said cycloaliphatic hydrocarbon contains from about 12 to 70 carbon atoms and at least one saturated ring containing at least 6 carbon atoms;

where components (A) and (B) of said traction fluid remain compatible and miscible when cooled to −40° F. and said traction fluid has a kinematic viscosity of less than 15,000 centistokes at −20° F.

The improved traction drive systems described herein are particularly well suited for operating in temperature extremes as low as −40° F.

DETAILED DESCRIPTION OF THE INVENTION AND PREFERRED EMBODIMENTS

As indicated above, the traction fluids of this invention consist essentially of (A) 30–100% by weight of a trimethylsiloxy end-blocked siloxane fluid of (MeRSiO) units and, optionally, ($Me_2SiO$) units where Me is a methyl radical and R is selected from the group consisting of phenyl radicals and cyclohexyl radicals, where there are about 1.6 to 14 methyl radicals for each R radical, said siloxane fluid having a kinematic viscosity of about 20 to 200 centistokes at 77° F.; and (B) 0–70% by weight of a cycloaliphatic hydrocarbon or a mixture of cycloaliphatic hydrocarbons, where said cycloaliphatic hydrocarbon contains from about 12 to 70 carbon atoms and at least one saturated ring containing at least 6 carbon atoms;

where components (A) and (B) of said traction fluid remain compatible and miscible when cooled to −40° F. and said traction fluid has a kinematic viscosity of less than 15,000 centistokes at −20° F.

When blends of the siloxane fluid component (A) and the cycloaliphatic hydrocarbon component (B) are used, it is preferred that the blend consist essentially of 30–70% by weight component (A) and 30–70% by weight component (B).

The blends of this invention differ from that of the prior art patent 4,190,546 in that a co-solvent is not required in the present invention to obtain compatible and miscible mixtures at −40° F. The siloxanes of the present invention can be represented by the average formula $$Me_3SiO(MeRSiO)_x(Me_2SiO)_ySiMe_3 \qquad \text{I}$$

where Me represents a methyl group and R is either a phenyl or cyclohexyl group; x is greater than zero, y is greater than or equal to zero and x and y are selected such that (1) the average Me/R ratio of the fluid is between about 1.6 to 14 and (2) the siloxane viscosity is between about 20 to 200 centistokes at 77° F. The prior art siloxane of U.S. Pat. No. 4,190,546 contained considerably fewer phenyl radicals on the average than does the siloxane of the present invention; the ratio of the Me radical to phenyl radical of the prior art siloxane of U.S. Pat. No. 4,190,546 was from 15 to 25. By increasing the phenyl (and/or cyclohexyl) content of the siloxane fluid we have discovered that blends of our siloxanes and cycloaliphatic hydrocarbons remain compatible, miscible, and flowable when cooled to −40° F. It is particularly preferred that the Me/R ratio be from about 3 to about 8 in formula I and the viscosity of the siloxane should be between 40 and 100 centistokes at 77° F.

Although the siloxanes useful in this invention preferably contain only diorgano- and triorgano-functional siloxane units, as defined above, a limited amount of mono-organo functional siloxane units of the general formula ($R'SiO_{3/2}$), where R′ can be methyl, phenyl, or cyclohexyl radicals, can be present without adversely affecting the properties of the siloxane traction fluids or traction fluids containing the siloxane fluids. The ($R'SiO_{3/2}$) content should be kept below about 5% by weight and preferably below 1% by weight in the siloxanes of this invention.

The cycloaliphatic hydrocarbons useful in the present invention are disclosed in U.S. Pat. Nos. 3,440,894 and 3,994,816. The cycloaliphatic hydrocarbons suitable for this invention contain at least one saturated ring containing at least six carbon atoms and from about 12 to 70 total carbon atoms. The preferred cycloaliphatic hydrocarbons contain at least two cyclohexyl rings and about 13 to 40 carbon atoms. The most preferred cycloaliphatic hydrocarbon is 2,4-dicyclohexyl-2-methyl pentane. Monsanto sells preferred cycloaliphatic hydrocarbons under the tradename Santotrac. The cycloaliphatic hydrocarbon can be prepared by several methods known in the art. One such method, yielding preferred compounds, is the dimerization of styrene, alpha-methyl styrene, the alkylated styrenes or the alkylated alpha-methyl styrenes followed by catalytic hydrogenation. The dimerization can lead to either mainly cyclic or linear products depending upon the reaction conditions employed. See, for example, Ipatieff, et al. U.S. Pat. No. 2,514,546 (July 11, 1950) and Ipatieff, et al. U.S. Pat. No. 2,622,110 (Dec. 16, 1952). Hydrogenation of the dimer products can be readily carried out by well-known procedures to yield the cycloaliphatic hydrocarbons. The preferred 2,4-dicyclohexyl-2-methyl pentane can be prepared by the hydrogenation of the linear dimer produced from alpha-methyl styrene, as described in U.S. Pat. No. 3,994,816. As noted in U.S. Pat. No. 3,994,816, the linear dimer can contain small amounts of the cyclic dimer which, upon hydrogenation, yield 1-cyclohexyl-1,3,3-trimethylhydrindane. Small amounts of the product from the cyclic dimer should not greatly affect the properties of the disclosed compositions nor their utility.

The preparation of the blends of siloxane (A) and cycloaliphatic hydrocarbon (B) can be accomplished by conventional techniques and methods for blending two or more liquids. The blending can be done at room temperature or at elevated temperatures. Any preference for the method, equipment, or temperature used for blending components (A) and (B) is a matter of convenience.

The blends of various siloxanes and cycloaliphatic hydrocarbons as described herein have been found to be useful as traction fluids in that they possess high traction coefficients and good low temperature viscosity properties.

It has also been found that the siloxanes useful in the blends also are useful without the addition of the cycloaliphatic hydrocarbons. The omission of the cycloaliphatic hydrocarbon yields traction fluids which, in general, have somewhat lower traction coefficients but somewhat better low temperature viscosity properties than their blended counterparts.

The siloxanes of this invention, which are useful as traction fluids, consist essentially of a trimethylsiloxy endblocked siloxane fluid of (MeRSiO) units and, optionally, ($Me_2SiO$) units where Me is a methyl radical and R is selected from the group consisting of phenyl radicals and cyclohexyl radicals, where there are about 1.6 to 14 methyl radicals for each R radical, said siloxane fluid having a kinematic viscosity of about 20 to 200 centistokes at 77° F. and a kinematic viscosity of less than 15,000 centistokes at −20° F.

The siloxanes which are useful as traction fluids without the necessity of blending with cycloaliphatic hydrocarbon can be described as in formula I above. When R is a phenyl radical it is preferred that both (MePhSiO) and ($Me_2SiO$) units, where Ph represents a phenyl radical, are present in the siloxane in addition to the ($Me_3SiO_{1/2}$) endblocking units. This preference is based on the higher traction coefficient of the methylphenylsiloxane and dimethylsiloxane copolymers as compared to the methylphenylsiloxane homopolymers.

On the other hand, it has been found that, when R is a cyclohexyl radical, the homopolymer (i.e., trimethylsiloxy endblocked methylcyclohexylsiloxane) has a higher traction coefficient than do the methylcyclohexylsiloxane/dimethylsiloxane copolymers. Therefore, based on the magnitude of the traction coefficient, when R is a cyclohexyl radical the preferred species is the homopolymer containing methylcyclohexylsiloxane units.

Whether R is phenyl or cyclohexyl and whether the siloxane is a homopolymer or copolymer containing dimethylsiloxane units, it is required that the siloxanes contain from about 1.6 to 14 methyl radicals per each phenyl or cyclohexyl radical. Preferably the Me/R ratio should be in the range of about 3 to about 8. The siloxane traction fluids of the present invention differ in two major areas from the siloxanes of the prior art that have been evaluated as traction fluids. First, the siloxanes of this invention have a lower Me/R ratio than the prior art siloxane fluids described in the technical paper by Rounds cited above. The methylphenylsiloxanes of the prior art had Me/R ratios greater than 15. The second difference is that the prior art silotane fluids have lower traction coefficients than do the siloxanes of the present invention.

As noted earlier in the discussion of the siloxane useful for blending with cycloaliphatic hydrocarbons, the siloxanes of this invention can contain a limited amount of $R'SiO_{3/2}$ units. The amounts of $R'SiO_{3/2}$ units should be less than 5% by weight and preferably less than 1% by weight.

The siloxanes of the invention should have a viscosity of between about 20 to 200 centistokes and perferably between 40 and 100 centistokes at 77° F. Furthermore, the viscosity at −20° F. should be less than 15,000 centistokes. The desired viscosity of the siloxane can be arrived at by the proper selection of x and y in formula I keeping in mind the limitation required for the Me/R ratio. The siloxanes of this invention can also be prepared by blending several different siloxanes so that the average composition meets the requirements concerning the viscosity and Me/R ratio.

The siloxanes useful as traction fluids alone and the siloxanes useful in preparing traction fluid blends with cycloaliphatic hydrocarbon can be prepared by methods well known in the art. Several procedures for the preparation of the siloxanes are illustrated in the Examples below.

The traction fluids of this invention are naturally intended for use in traction drives, traction drive systems, or traction devices by which torque is transmitted via rolling elements in nominal line or point contact. These traction fluids are especially well suited for use in such traction drives, systems, or devices subjected to temperature extremes as low as −40° F. The use of these traction fluids result in improved traction drive systems. One such traction drive system is the traction drive transmission for motor vehicles. Additionally, these traction fluids would be useful in limited slip differentials. In limited slip differentials these traction fluids could be either the original fluid or added to a worn limited slip differential. In either case the limited slip differential using these traction fluids should exhibit a longer useful lifetime. Also the traction fluids of this invention could be used as hydraulic fluids or as automatic transmission fluids.

It does not appear that specifications for traction fluids have been developed. However, reasonable specifications for viscosity and traction properties might be given as follows: (1) a minimum viscosity of 5.0 centistokes at 210° F.; (2) a maximum viscosity of 15,000 centistokes at −20° F.; and (3) a minimum traction coefficient of 0.06 as measured under standard conditions (as defined below). For some applications the viscosity requirement at −20° F. may be significantly lower. As can be seen from the Examples given below, the traction fluids of this invention meet and in many cases exceed the above reasonable specifications.

The following Examples are merely illustrative and are not intended to limit the invention.

In the Examples all viscosities are kinematic viscosities and are reported in centistokes.

Traction measurements were made on test equipment developed by Traction Propulsion, Inc. of Austin, Tex. The test machine consists essentially of two identical flat bearing races (standard Torrington, 3.5 inches diameter) turned by separate shafts. The shafts are parallel and 2.75 inches apart. The bearing area of the races face each other and are about 1.5 inches apart. A single 1.50 inch diameter ball (AISI No. E-52100 steel, Rockwell hardness 62–64), mounted on a movable spindle, is positioned between and in contact with the two bearing races such that a line drawn between the two contact points will intersect the center of the ball. The two shafts carrying the bearing races are connected by timing chains so that each race turns at the same angular speed and direction during a fluid evaluation. The races are loaded against the ball, and thus indirectly against each other, by means of a hydraulic piston to give the desired mean Hertz load. The Hertz load is calculated as the applied load divided by the nominal contact area between the race and the ball. When the ball is positioned equidistant from the centers of the two rotating races, there is no sliding ("creep") in the lubricated contacts between the races and the ball because rolling speeds at both contact points are equal. By moving the ball toward the center of one of the races a difference in surface speed between the two contacts is produced giving rise to a calculated "creep". This creep (in percent) is defined as the sliding speed divided by the rolling speed, times 100. The creep was held at 1.42% in all traction coefficient determinations reported here.

This creep produces a tangential or traction force on the surface of the ball which is experimentally measured as the force required to maintain the ball in the required position for a creep value of 1.42%. The test lubricant is pumped through orifices directly at the two contact points between the ball and the races after first being passed through a heat exchange to obtain the desired fluid temperature. The temperature was 140° F. in all experiments reported herein. The apparatus is throughly cleaned before a new test fluid is introduced. The traction coefficient of a given fluid under a given set of experimental conditions (i.e. mean Hertz load, rolling speed, creep, temperature) is determined from the equation $$f_t = \frac{\text{tangential force}}{2(\text{normal force})}$$

where the tangential force is the force required to keep the ball in the required position for a given creep value and the normal force is the force applied via the piston forcing the races against the ball. The factor of 2 enters the above equation since there are two contact points.

Standard conditions for the determination of traction coefficients are defined as: 140° F. fluid temperature, 1.42% creep, mean Hertz pressure of 200,000 psi, and a rolling speed of 35 feet/sec.

Throughout the Examples the various siloxanes and blends of traction fluids will be identified by reference to the Example number in which they were first described. For example, siloxane I is that siloxane described in Example I; siloxane V-b is that siloxane described in Example V, part b, etc.

EXAMPLE I

Trimethylsiloxy endblocked homopolymer of cyclohexylmethylsiloxane

A two liter, stainless steel Parr Reactor was loaded with 500 g. (4.3 moles ≡Si-H) of $Me_3SiO(MeHSiO)_x$-

$SiMe_3$ with x=2, 3, and 4; 442 g. (25% excess) cyclohexene; and 2 ml. of 0.1 M chloroplatinic acid in isopropanol. The reactor was sealed and heated to 110°-130° C. for a total of 100 hours. Small, additional amounts of the platinum catalyst were added after 9 and 55 hours of reaction. Finally 60 g. of 1-octene was added to react with the remaining ≡SiH and reaction continued for 6 hours. The reactor was then cooled to room temperature and 984 g. of crude product was recovered.

The crude product was vacuum distilled to a vapor temperature of 150° C. at 10 mm Hg to remove volatile components. 759 g. of product residue was recovered (89% of theory). The product was stirred with 15 g. of fuller's earth for two hours and then filtered.

Analysis: Methyl/cyclohexyl ratio: ca. 3.2; specific gravity: 0.941; refractive index: 1.4498; percent Si-H, 0.019; viscosity (centistokes) at various temperatures:

| Viscosity | | | | | |
|---|---|---|---|---|---|
| −40 | −20 | 0 | 77 | 100 | 210° F. |
| 4,046 | 1,084 | 275 | 28 | 19 | 5 |

EXAMPLE II

Trimethylsiloxy endblocked copolymer of cyclohexylmethylsiloxane and dimethylsiloxane A two liter, 3-neck Pyrex glass flask fitted with thermometer, reflux condenser, addition funnel, and magnetic stirrer was loaded with 750 g. of a siloxane copolymer of average composition $Me_3SiO(Me_2SiO)_{8.3}(MeHSiO)_{3.4}SiMe_3$. A nitrogen sweep was maintained at the open end of the condenser throughout the reaction. The contents of the flask were heated to 120° C. A mixture of 246.5 g. cyclohexene and 1 ml. of 0.1 M chloroplatinic acid in isopropanol was added dropwise over a two-hour period. The temperature was kept between 100° and 135° C., by heating when required, during the addition and for 29 hours thereafter. During this 29-hour period, 0.1 ml. of the platinum catalyst solution in 25 g. cyclohexene (after 4.3 hours of reaction) and 0.5 ml. of the platinum catalyst solution (after 24 hours) was added. After the 29 hour reaction period 56 g. of 1-octene was added and the reaction continued at 100°-135° C. for six hours to complete reaction of ≡Si-H groups.

The crude reaction product was vacuum distilled to a vapor temperature of 180° C. at 20 mm Hg to remove volatile components. After the residue was stirred with 20 g. of fuller's earth for 1 hour and filtered, 815 g. of fluid product were obtained.

Analysis: Methyl/cyclohexyl ratio: ca 7.6; specific gravity: 0.970; refractive index; 1.4326; viscosity (centistokes) at various temperatures:

| Viscosity | | | | | |
|---|---|---|---|---|---|
| −40 | −20 | 0 | 77 | 100 | 210° F. |
| 1,580 | 654 | 339 | 48.4 | 33.5 | 12.0 |

EXAMPLE III

Trimethylsiloxy endblocked homopolymer of methylphenylsiloxane

Siloxane III was prepared by combining various product fractions from two production scale equilibrations of phenylmethylsiloxane cyclics and hexamethyldisiloxane as detailed below.

Equilibration One: A steel reaction kettle was charged with 2500 pounds of phenylmethylsiloxane cyclics, 350 pounds of hexamethyldisiloxane, and 19 pounds of 45% aqueous potassium hydroxide. The kettle was purged with nitrogen, stirred, and heated to reflux. The reaction mixture was refluxed 7 hours (final reflux temperature 156° C.). The reaction mixture was then cooled and an additional 350 pounds hexamethyldisiloxane was added. The refluxing was again initiated and continued for 15 hours. In all, 4 more additions of 350 pound charges of hexamethyldisiloxane were made in the same manner with refluxing continuing for 19, 9, 30, and 28 hours, respectively, after each addition. Because of various mechanical problems throughout the reaction, which caused the process to be shut off several times, an estimated 650 pounds of hexamethyldisiloxane was lost through the vent.

The reaction was judged complete after 2100 pounds of hexamethyldisiloxane had been added and the reaction mixture had been refluxed about 110 hours. The reaction mixture was then acidified with trimethylchlorosilane to a 0.059 acid number. The acid number is defined as the number of milliequivalents of potassium hydroxide required to neutralize a one gram sample. The reaction mixture was then passed through a filter press precoated with filter aid. This filtration was very difficult as it required numerous changes of the filter pad.

The crude reaction mixture was then strip distilled. Low boiling volatiles (505 pounds) were removed overhead at atmospheric pressure and a pot temperature of 240° C. Next a crude product cut (1592 pounds, labeled CP-I) was collected overhead to a pot temperature of 300° C. under full vacuum pulled by a stokes mechanical pump. The strip residue (labeled SR-I) weighed 1240 pounds.

Equilibration Two: A steel reaction kettle was charged with 2500 pounds of phenylmethylsiloxane cyclics, 700 pounds of hexamethyldisiloxane, 72 pounds of diethylene glycol dimethyl ether (Ansul 141), and 10 pounds of 45% aqueous potassium hydroxide. The Ansul 141, a promotor, was used because of the long equilibration time required in Equilibration One. This mixture was refluxed for 20 hours during which time the pot temperature rose from 105° to 147° C. The product was then cooled and analyzed. Specific gravity, 1.037; refractive index, 1.5045; alkaline number, 1.00. The alkaline number is the milliequivalents of acid required to neutralize a one gram sample. An additional 800 pounds of hexamethyldisiloxane was added and the mixture reheated to reflux for another 22 hours. The pot temperature rose from 119° to 150° C. at reflux. The crude mixture had a specific gravity of 0.976, a refractive index of 1.4750, and an alkaline number 0.76. Trimethylchlorosilane was added to an acid number of 0.062 in order to neutralize the catalyst. The product was filtered and distilled as in Equilibration One. In this case, however, the filtration step was somewhat easier. There was obtained a low volatile cut, 2018 pounds of crude product (CP-II) and 1512 pounds of strip residue (SR-II).

The crude product cuts from both equilibration runs (CP-I and CP-II) were combined, filtered, and fractionally distilled. Additionally, 350 pounds of volatiles (mostly hexamethyldisiloxane) were added by mistake to the CP-I and CP-II cuts before distillation. About 471 pounds of volatile material (including material added by mistake) was distilled off at 100 mm Hg and a pot temperature of 140° C. A second cut (1099 pounds) was taken at 13 mm Hg and a vapor temperature of 102°-190° C. A third cut (866 pounds) was removed at 13 mm Hg and a vapor temperature of 190°-208° C. A fourth cut (460 pounds, mostly linear pentamer) was then taken by lowering the pressure to 3 mm Hg with a vapor temperature between 128° and 201° C. A distillation residue (labeled DS) of 630 pounds remained.

Siloxane III (a trimethylsiloxy endblocked homopolymer of methylphenylsiloxane) was prepared by blending the following fractions from equilibration one, two, and the final combined fractional distillation:

| | |
|---|---|
| Distillation Residue (DS) | 4 pounds |
| Fourth cut (fractional distillation) | 12 pounds |
| Strip residue (SR-I and SR-II combined) | 24 pounds |

The distillation residue (DS) had a refractive index of 1.5054 and a viscosity of 30.3 cS at 25° C. The fourth cut had a specific gravity of 1.001, a refractive index of 1.4886, and 11.6 cS viscosity at 25° C. The combined strip residue from equilibration one and two had a viscosity of 84 cS at 25° C.

Siloxane III had the following analysis: Methyl/phenyl ratio: ca 2.5; specific gravity, 1.00; viscosity (centistokes) at various temperatures:

| Viscosity | | | | | |
|---|---|---|---|---|---|
| −40 | −20 | 0 | 77 | 100 | 210° F. |
| >10,000 | 1,875 | 458 | 36.7 | 23 | 6.2 |

Siloxane III could also be prepared by a simpler and more direct route. For example, this fluid can be prepared by heating appropriate amounts of phenylmethylsiloxane cyclics and hexamethyldisiloxane in the presence of diethylene glycol dimethyl ether (Ansul 141), and potassium hydroxide to reflux under a nitrogen atmosphere. The reaction mixture is made slightly acidic by the addition of trimethylchlorosilane, filtered, and then strip distilled. The residue product is then collected. Instead of using the Ansul 141 as a reactor promotor, increased pressure can also be used to increase the reaction rate.

EXAMPLE IV

Trimethylsiloxy endblocked copolymer of methylphenylsiloxane and dimethylsiloxane A copolymer of average formula $Me_3SiO(PhMeSiO)_{5.3}(Me_2SiO)_{5.3}SiMe_3$ was prepared by equilibrating a mixture of phenylmethylsiloxane cyclics and a copolymer of average formula $Me_3SiO(Me_2SiO)_{5.3}SiMe_3$ by the following procedure. A 2 liter, 3-necked Pyrex glass flask equipped with a magnetic stirrer, thermometer, and a condenser was charged with 553 g. (1 mole) of a copolymer $Me_3SiO(Me_2SiO)_{5.3}SiMe_3$, 721 g. (5.3 equivalents) phenylmethylsiloxane cyclics, and 1.27 g. flaked potassium hydroxide. The reaction mixture, under a nitrogen atmosphere, was then heated to reflux with continuous agitation. The reaction mixture was maintained at the reflux temperature (160° C.) for about 3 hours. The mixture was then cooled to 40° C. and 2.5 g. trimethylchlorosilane was added to neutralize the catalyst. Stirring was continued for an additional hour and then the mixture was filtered. The crude reaction mixture was then vacuum distilled to a vapor temperature of 179° C. at 25 mm Hg. The residue product (weighing 1104 g.) was then collected and analyzed as follows.

Analysis: Methyl/phenyl ratio: ca 4.1; specific gravity: 1.040; refractive index: 1.4832; pour point, <−79° F.; viscosity (centistokes) at various temperatures:

| Viscosity | | | | | |
|---|---|---|---|---|---|
| −40 | −20 | 0 | 77 | 100 | 210° F. |
| 2,303 | 733 | 346 | 45 | 29 | 9 |

As is well known in the art, the above-named copolymer could also have been prepared, for example, by equilibrating appropriate amounts of dimethylsiloxane cyclics, phenylmethylsiloxane cyclics, and hexamethyldisiloxane.

EXAMPLE V

Trimethyl endblocked copolymers of methylphenylsiloxane and dimethylsiloxane Other examples of the above-named copolymers were prepared by a similar procedure as described in Example IV. The ratios of the ($Me_3SiO_{1/2}$), ($Me_2SiO$), and (PhMeSiO) units were varied to obtain the desired compositions and Me/Ph ratios.

The following fluids were prepared:

| | Weight Percent | | | |
|---|---|---|---|---|
| Fluid | $Me_3SiO_{\frac{1}{2}}$ | PhMeSiO | $Me_2SiO$ | Me/Ph |
| V-a | 7.3 | 52.5 | 40.2 | 4.5 |
| V-b | 8.8 | 41.5 | 49.6 | 6.4 |
| V-c | 15 | 25 | 60 | 13.1 |

The viscosities (in centistokes) as a function of temperature of the above-described fluids are as follows:

| | Viscosity | | | | | |
|---|---|---|---|---|---|---|
| Fluid | −40 | −20 | 0 | 77 | 100 | 210° F. |
| V-a | 2,122 | 800 | 358 | 59 | 41 | 13 |
| V-b | 779 | 417 | 199 | 44 | 31.6 | 11.6 |
| V-c | 770 | 324 | 180 | 36.7 | 27.3 | 10.1 |

The specific gravity of these fluids was determined as follows: V-a, 1.032; V-b, 1.018; and V-c, 1.014.

For comparison purposes several copolymers outside the scope of this invention were prepared.

| | Weight Percent | | | |
|---|---|---|---|---|
| Fluid | $Me_3SiO_{3/2}$ | MePhSiO | $Me_2SiO$ | Me/Ph |
| V-d | 9 | 70 | 21 | 2.7 |
| V-e | ~4 | ~18 | ~78 | ~18 |

The viscosities as a function of temperature for fluids V-d and V-e are as follows:

| | Viscosity | | | | | |
|---|---|---|---|---|---|---|
| Fluid | −40 | −20 | 0 | 77 | 100 | 210° F. |
| V-d | — | 22,000 | — | 115 | 84 | 20 |
| V-e | — | 275 | — | 50 | 38 | 14 |

It can be seen from fluid V-d that if the (MePhSiO) content in a phenylmethylsiloxane dimethylsiloxane copolymer is too high (even though the Me/Ph ratio is in the required range), the low temperature viscosity can be high. Fluid V-e is outside the scope of the present invention due to its high Me/Ph ratio, indicating too few phenyl methyl siloxane groups in the copolymer. Fluid V-e is similar to the siloxane fluid used in blends with Santotrac fluid in U.S. Pat. No. 4,190,546.

EXAMPLE VI

Blends of various proportions of the siloxane fluids described in the above Examples and several cycloaliphatic hydrocarbon traction fluids were prepared by mixing the components together in a suitable container at room temperature. The cycloaliphatic hydrocarbon traction fluids employed were obtained from Monsanto under the tradename Santotrac. Two grades of Santotrac fluids were employed: (1) Santotrac 40, a cycloaliphatic hydrocarbon containing no reported additives and (2) Santotrac 50, a cycloaliphatic hydrocarbon reported to contain conventional additives to reduce wear, rust, and foam in actual use. The viscosities of the Santotrac fluids as a function of temperature are as follows:

| | Viscosity | | | | | |
|---|---|---|---|---|---|---|
| | −40 | −20 | 0 | 77 | 100 | 210° F. |
| Santotrac 40 | >200,000* | 31,600 | 3,000* | 45 | 22.7 | 3.7 |
| Santotrac 50 | >1,000,000* | 41,500 | 5,120 | 75 | 33.6 | 5.6 |

*Estimated

The following siloxane/Santotrac blends were prepared (all percentages by weight):

| Blend | Composition |
|---|---|
| VI-a | 50% siloxane IV<br>50% Santotrac 40 |
| VI-b | 50% siloxane IV<br>50% Santotrac 50 |
| VI-c | 50% siloxane V-a<br>50% Santotrac 40 |
| VI-d | 60% siloxane V-a<br>40% Santotrac 50 |
| VI-e | 50% siloxane V-b<br>50% Santotrac 50 |
| VI-f | 33.5% siloxane V-c<br>66.5% Santotrac 50 |
| VI-g | 50% siloxane V-c<br>50% Santotrac 50 |
| VI-h* | 40% siloxane V-d<br>60% Santotrac 50 |
| VI-i** | 28.5% siloxane V-e<br>66.5% Santotrac 50<br>5% Diphenyl ether |

*For comparison purposes only.
**For comparison purposes only. This composition is similar to Blend 9 of U.S. Pat. No. 4,190,546.

The viscosity-temperature relationship of the above blends is given below.

| | Viscosity | | | | | |
|---|---|---|---|---|---|---|
| Blend | −40 | −20 | 0 | 77 | 100 | 210° F. |
| VI-a | 15,618 | 2,700 | 558 | 30 | 18.3 | 4.6 |
| VI-b | 15,164 | 2,720 | 699 | 39 | 24 | 6.0 |
| VI-c | 12,244 | 2,154 | 603 | 36 | 23 | 5.8 |
| VI-d | 8,388 | 1,856 | 488 | 44 | 28.3 | 7.8 |
| VI-e | 6,881 | 1,598 | 457 | 39 | 24.6 | 6.9 |
| VI-f | 31,400 | 5,000 | 989 | 40 | 25.2 | 6.0 |
| VI-g | 4,134 | 921 | 332 | 28 | 18.3 | 6.0 |
| VI-h* | Frozen | 10,483 | — | — | — | — |

-continued

| | Viscosity | | | | | |
|---|---|---|---|---|---|---|
| Blend | −40 | −20 | 0 | 77 | 100 | 210° F. |
| VI-i* | Frozen | 1,978 | 638 | 36 | 22 | 6.0 |

*For comparison purposes only.

As can be seen in Examples I–VI the siloxanes and the blends of siloxanes with the cycloaliphatic hydrocarbon fluid of this invention exhibit low viscosities at temperatures as low as −40° F. On the other hand, the prior art traction fluids (i.e., the Santotrac fluids alone and the blend of siloxane, Santotrac 50, and diphenyl ether (fluid VI-i) of U.S. Pat. No. 4,190,546) are not flowable at −40° F. In fact, the viscosity of the Santotrac fluids at −20° F. is higher than the viscosity of the traction fluids of this invention at −40° F. Additionally, the blends of this invention remain miscible when cooled repeatedly to −40° F. Based on the viscosity data presented, the siloxanes and the blends of siloxanes and cycloaliphatic hydrocarbons are indeed suitable for use at temperatures as low as −40° F. in a traction drive system.

EXAMPLE VII

The traction coefficients of several of the siloxanes described in Examples I-V have been determined. These fluids were tested at 140° F. and a creep value of 1.42%. Both the average Hertz pressure and the rolling speed were varied. The results are given below. Traction coefficients for the commercially available traction fluids Santotrac 50 and Mobil 62 are also listed. Mobil 62 is a highly refined naphthenic mineral oil.

| TRACTION TEST CONDITIONS | | TRACTION COEFFICIENT | | | | | | |
|---|---|---|---|---|---|---|---|---|
| Rolling Speed (fps) | Average Hertz Pressure (Kpsi) | I | II | III | IV | V-c | Santotrac 50* | Mobil 62* |
| 15 | 150 | 0.080 | 0.077 | 0.067 | 0.072 | — | 0.095 | 0.062 |
| 35 | 150 | 0.073 | 0.074 | 0.063 | 0.067 | 0.067 | 0.093 | 0.060 |
| 65 | 150 | 0.067 | 0.060 | 0.060 | 0.059 | — | 0.086 | 0.065 |
| 100 | 150 | 0.062 | 0.053 | 0.056 | 0.055 | 0.058 | 0.077 | 0.049 |
| 15 | 200 | 0.083 | 0.082 | 0.074 | 0.078 | — | 0.087 | 0.066 |
| 35 | 200 | 0.078 | 0.079 | 0.072 | 0.072 | 0.071 | 0.091 | 0.064 |
| 65 | 200 | 0.073 | 0.068 | 0.065 | 0.066 | — | 0.085 | 0.062 |
| 100 | 200 | 0.067 | 0.059 | 0.059 | 0.061 | — | 0.079 | 0.057 |
| 35 | 250 | 0.082 | 0.082 | 0.072 | 0.073 | 0.076 | 0.084 | 0.074 |
| Average | | 0.074 | 0.070 | 0.065 | 0.067 | —** | 0.086 | 0.062 |

*For comparison purposes.
**Average not calculated because of limited data.

In general, the traction coefficients of the siloxanes of this invention are numerically between those observed for the two commercial traction fluids, Santotrac 50 and Mobil 62. The traction coefficients of Santotrac 50 are higher than the coefficients of the siloxanes. The traction coefficient of the siloxanes are, on the average, about 80–85% of those observed for Santotrac 50 and about 110–120% of those observed for Mobil 62 under the same experimental conditions. The traction coefficients are high enough so that these siloxanes will be useful in a traction drive. Considering the low temperature viscosities reported in Examples I–V these fluids would be useful as low temperature traction fluids.

EXAMPLE VIII

The traction coefficients of several of the blends of siloxane fluids and the cycloaliphatic hydrocarbon (Santotrac 50) have been determined. The fluid blends were tested at 140° F. and a creep value of 1.42% under varying average Hertz pressure and rolling speed values. For comparison purposes the traction coefficients of Santotrac 50 and Blend VI-i (a composition similar to Blend 9 of U.S. Pat. No. 4,190,546) are also included.

| TRACTION TEST CONDITIONS | | | | | |
|---|---|---|---|---|---|
| Rolling Speed (fps) | Average Hertz Pressure (Kpsi) | TRACTION COEFFICIENT | | | |
| | | VI-b | VI-g | VI-i* | Santotrac* |
| 15 | 150 | 0.081 | 0.084 | 0.086 | 0.095 |
| 35 | 150 | 0.077 | 0.077 | 0.084 | 0.093 |
| 65 | 150 | 0.072 | 0.067 | 0.070 | 0.086 |
| 100 | 150 | 0.067 | 0.063 | 0.072 | 0.077 |
| 15 | 200 | 0.092 | 0.083 | 0.091 | 0.087 |
| 35 | 200 | 0.086 | 0.079 | 0.083 | 0.091 |
| 65 | 200 | 0.075 | 0.076 | 0.077 | 0.085 |
| 100 | 200 | 0.070 | 0.060 | 0.073 | 0.079 |
| 35 | 250 | 0.086 | 0.080 | 0.079 | 0.084 |
| Average | | 0.078 | 0.074 | 0.079 | 0.086 |

*For comparison purposes.

Sample VI-b is a 50/50 by weight blend of siloxane IV-a and Santotrac 50. Sample VI-g is a 50/50 by weight blend of siloxane V-c and Santotrac 50. The average traction coefficients for Blends VI-b and VI-g are about 85–91% of the value for Santotrac 50. The average traction coefficients of Blends VI-b and VI-g are about equivalent to that found for Blend VI-i, the blend of siloxane V-e, Santotrac 50, and diphenylether prepared similarly to Blend 9 of U.S. Pat. No. 4,190,546. However, as indicated in Example VI, the low temperature viscosity properties of Blends VI-b and VI-g are much better than that found for the two prior art fluids. Additionally, the blends of this invention avoid the problem associated with the use of a co-solvent as used in VI-i. In other words, blends VI-b and VI-g demonstrate that the blends of this invention have traction coefficients and low temperature viscosity properties that render these blends ideally suited for use in traction drive systems subjected to low temperature extremes.

EXAMPLE IX

The siloxane fluid I had the highest average traction coefficient of the siloxanes examined in Examples I-V. Thus, it seems reasonable to assume that a blend of siloxane I and a Santotrac fluid should also have a high traction coefficient, perhaps even higher than those reported for blends of this invention in Example VIII. Using the average traction coefficients of siloxane I and Santotrac 50 and the relationship $$f_t = f_{t1}C_1 + f_{t2}C_2$$

as defined earlier, a 50/50 blend of the siloxane I and Santotrac 50 has a calculated average traction coefficient of 0.080. Likewise, a value of 0.078 can be determined as the average traction coefficient for a 50/50 blend of siloxane II and Santotrac 50. A 50/50 blend of siloxane III and Santotrac 50 has a calculated value of 0.076 for the traction coefficient. For comparison purposes, a blend (50/50) of siloxane IV and Santotrac 50 (actual blend VI-b) has a calculated average traction coefficient of 0.076. The actual experimentally determined value is 0.078. The error between the calculated and experimentally determined value is about 2.5%.

It should be noted that the siloxane or siloxane/cycloaliphatic hydrocarbon blend with the highest traction coefficient is not necessarily the most preferred species of this invention. For an application where the low temperature viscosity requirement is critical, the designer or user of the traction drive may be willing to accept a somewhat low traction coefficient in order to obtain, for example, a viscosity of less than 1000 cS. at −40° F. In other applications where the low temperature viscosity is not as critical (but still required to be less than 15,000 cS. at −20° F.) the fluid possessing the highest traction coefficient may be preferred. In other words, for any given end use, different traction fluids of this invention may be preferred.

It will be readily understood by those of ordinary skill in the art that the demonstration of Santotrac and siloxane blends as traction fluids in several of the above examples teaches the usefulness of other cycloaliphatic hydrocarbons, as herein described, when blended with the described siloxane fluids.

That which is claimed is:

1. A traction fluid consisting essentially of (A) 30–70% by weight of a trimethylsiloxy endblocked siloxane fluid of (MeRSiO) units and, optionally, ($Me_2SiO$) units where Me is a methyl radical and R is selected from the group consisting of phenyl radicals and cyclohexyl radicals, where there are about 1.6 to 14 methyl radicals for each R radical, said siloxane fluid having a kinematic viscosity of about 20 to 200 centistokes at 77° F.; and (B) 30–70% by weight of a cycloaliphatic hydrocarbon or a mixture of cycloaliphatic hydrocarbons, where said cycloaliphatic hydrocarbon contains from about 12 to 70 carbon atoms and at least one saturated ring containing at least six carbon atoms;

where components (A) and (B) of said traction fluid remain compatible and miscible when cooled to −40° F. and said traction fluid has a kinematic viscosity of less than 15,000 centistokes at −20° F.

2. A traction fluid as defined in claim 1 wherein the trimethylsiloxy endblocked siloxane fluid contains (MeRSiO) units and ($Me_2SiO$) units where R is a phenyl radical.

3. A traction fluid as defined in claim 2 wherein the trimethylsiloxy endblocked siloxane fluid contains about 3 to about 8 methyl radicals per phenyl radical.

4. A traction fluid as defined in claim 1 wherein the trimethylsiloxy endblocked siloxane fluid contains (MeRSiO) units where R is a cyclohexyl radical.

5. A traction fluid as defined in claim 1 wherein the trimethylsiloxy endblocked siloxane fluid contains (MeRSiO) units and ($Me_2SiO$) units where R is a cyclohexyl radical.

6. A traction fluid as defined in claims 2, 3, 4, or 5 wherein the siloxane fluid has a kinematic viscosity of 40–100 centistokes at 77° F.

7. A traction fluid as defined in claims 2, 3, 4, or 5 wherein the cycloaliphatic hydrocarbon contains at least two cyclohexyl rings and about 13 to about 40 carbon atoms.

8. A traction fluid as defined in claims 2, 3, 4, or 5 wherein the cycloaliphatic hydrocarbon is 2,4-dicyclohexyl-2-methyl pentane.

9. A traction fluid consisting essentially of (A) 30–100% by weight of a trimethylsiloxy endblocked siloxane fluid of (MeRSiO) units and, optionally, ($Me_2SiO$) units where Me is a methyl radical and R is a cyclohexyl radical, where there are about 1.6 to 14 methyl radicals for each R radical, said siloxane fluid having a kinematic viscosity of about 20 to 200 centistokes at 77° F.;

and (B) 0–70% by weight of a cycloaliphatic hydrocarbon or a mixture of cycloaliphatic hydrocarbons, where said cycloaliphatic hydrocarbon contains from about 12 to 70 carbon atoms and at least one saturated ring containing at least six carbon atoms;

where components (A) and (B) of said traction fluid remain compatible and miscible when cooled to −40° F. and said traction fluid has a kinematic viscosity of less than 15,000 centistokes at −20° F.

10. A traction fluid as defined in claim 9 wherein the siloxane fluid contains (MeRSiO) units and wherein said traction fluid consists essentially of 100% of the siloxane fluid.

11. A traction fluid as defined in claim 9 wherein the siloxane fluid contains (MeRSiO) units and ($Me_2SiO$) units and wherein said traction fluid consists essentially of 100% of the siloxane fluid.

12. A traction fluid as defined in claims 10 or 11 wherein the siloxane fluid has a kinematic viscosity of 40–100 centistokes at 77° F.

13. In a traction drive system having at least two relatively rotatable members in a torque transmitting relationship and a traction fluid disposed on the tractive surfaces of said members, the improvement comprising employing, as said traction fluid, a fluid consisting essentially of (A) 30–70% by weight of a trimethylsiloxy endblocked siloxane fluid of (MeRSiO) units and, optionally, ($Me_2SiO$) units where Me is a methyl radical and R is selected from the group consisting of phenyl radicals and cyclohexyl radicals, where there are about 1.6 to 14 methyl radicals for each R radical, said siloxane fluid having a kinematic viscosity of about 20 to 200 centistokes at 77° F.; and (B) 30–70% by weight of a cycloaliphatic hydrocarbon or a mixture of cycloaliphatic hydrocarbons, where said cycloaliphatic hydrocarbon contains from about 12 to 70 carbon atoms and at least one saturated ring containing at least six carbon atoms;

where components (A) and (B) of said traction fluid remain compatible and miscible when cooled to −40° F. and said traction fluid has a kinematic viscosity of less than 15,000 centistokes at −20° F.

14. A traction drive system as defined in claim 13 wherein the trimethylsiloxy endblocked fluid contains (MeRSiO) units and ($Me_2SiO$) units where R is a phenyl radical.

15. A traction drive system as defined in claim 14 wherein the trimethylsiloxy endblocked siloxane fluid contains about 3 to about 8 methyl radicals per phenyl radical.

16. A traction drive system as defined in claim 13 wherein the trimethylsiloxy endblocked siloxane fluid contains (MeRSiO) units where R is a cyclohexyl radical.

17. A traction drive system as defined in claim 13 wherein the trimethylsiloxy endblocked siloxane fluid contains (MeRSiO) units and ($Me_2SiO$) units where R is a cyclohexyl radical.

18. A traction drive sytem as defined in claims 14, 15, 16, or 17 wherein the siloxane fluid has a kinematic viscosity of 40–100 centistokes at 77° F.

19. A traction drive system as defined in claims 14, 15, 16, or 17 wherein the cycloaliphatic hydrocarbon contains at least two cyclohexyl rings and about 13 to about 40 carbon atoms.

20. A traction drive system as defined in claims 14, 15, 16, or 17 wherein the cycloaliphatic hydrocarbon is 2,4-dicyclohexyl-2-methyl pentane.

21. In a traction drive system having at least two relatively rotatable members in a torque transmitting relationship and a traction fluid disposed on the tractive surfaces of said members, the improvement comprising employing, as said traction fluid, a fluid consisting essentially of (A) 30–100% by weight of a trimethylsiloxy endblocked siloxane fluid of (MeRSiO) units and, optionally, ($Me_2SiO$) units where Me is a methyl radical and R is a cyclohexyl radical, where there are about 1.6 to 14 methyl radicals for each R radical, said siloxane fluid having a kinematic viscosity of about 20 to 200 centistokes at 77° F.;

and (B) 0–70% by weight of a cycloaliphatic hydrocarbon or a mixture of cycloaliphatic hydrocarbons, where said cycloaliphatic hydrocarbon contains from about 12 to 70 carbon atoms and at least one saturated ring containing at least six carbon atoms;

where components (A) and (B) of said traction fluid remain compatible and miscible when cooled to −40° F. and said traction fluid has a kinematic viscosity of less than 15,000 centistokes at −20° F.

22. A traction drive system as defined in claim 21 wherein the siloxane fluid contains (MeRSiO) units and wherein said traction fluid consists essentially of 100% of the siloxane component.

23. A traction drive system as defined in claim 21 wherein the siloxane fluid contains (MeRSiO) units and ($Me_2SiO$) units and wherein said traction fluid consists essentially of 100% of the siloxane component.

24. A traction drive system as defined in claims 22 or 23 wherein the siloxane fluid has a kinematic viscosity of 40–100 centistokes at 77° F.

25. A traction drive system as defined in claims 15, 17, or 22 wherein said traction drive system is a traction drive transmission.

26. A traction drive system as defined in claim 20 wherein said traction drive system is a traction drive transmission.

27. A traction drive system as defined in claim 24 wherein said traction drive system is a traction drive transmission.

* * * * *